US007833310B2

(12) United States Patent
Kwon et al.

(10) Patent No.: US 7,833,310 B2
(45) Date of Patent: Nov. 16, 2010

(54) AIR FILTER, ELEVATOR HAVING THE SAME AND AIR CONDITIONING CONTROL METHOD THEREOF

(75) Inventors: Jun Hyoun Kwon, Seoul (KR); Rae Eun Park, Seongnam-si (KR); Eun Ju Ha, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 324 days.

(21) Appl. No.: 12/007,979

(22) Filed: Jan. 17, 2008

(65) Prior Publication Data

US 2009/0038473 A1 Feb. 12, 2009

(30) Foreign Application Priority Data

Aug. 6, 2007 (KR) ..... 10-2007-0078662

(51) Int. Cl.
*B03C 3/68* (2006.01)

(52) U.S. Cl. ..... 95/3; 95/4; 96/19; 96/63; 96/69; 96/97

(58) Field of Classification Search ..... 95/3, 95/4; 96/19, 63, 69, 97
See application file for complete search history.

(56) References Cited

U.S. PATENT DOCUMENTS 3,973,927 A * 8/1976 Furchner et al. ..... 95/3
4,284,417 A * 8/1981 Reese et al. ..... 95/3
4,502,002 A * 2/1985 Ando ..... 96/19
5,035,728 A * 7/1991 Fang ..... 96/19
5,660,605 A * 8/1997 Chan et al. ..... 96/19
5,759,487 A * 6/1998 Jung ..... 422/22
6,287,368 B1 * 9/2001 Ilmasti ..... 96/19
6,623,544 B1 * 9/2003 Kaura ..... 95/3
7,235,120 B2 * 6/2007 Dennis ..... 95/2
7,381,245 B2 * 6/2008 Fleischer ..... 96/18
2004/0216612 A1 * 11/2004 Dennis ..... 96/15
2006/0000359 A1 * 1/2006 Choi et al. ..... 96/63
2006/0005709 A1 * 1/2006 Choi et al. ..... 96/88
2006/0056129 A1 * 3/2006 Kim et al. ..... 361/230
2007/0165353 A1 * 7/2007 Fleischer ..... 361/212

FOREIGN PATENT DOCUMENTS

JP 6-292839 A * 10/1994
KR 1996-007420 3/1996

* cited by examiner

*Primary Examiner*—Richard L Chiesa
(74) *Attorney, Agent, or Firm*—Staas & Halsey LLP

(57) ABSTRACT

An air filter, an elevator having the same, and an air conditioning control method thereof purify the air inside the elevator to make the air safe and pleasant using a micro plasma ion generator (MPI). The elevator includes a cage which moves up and down in a vertical direction of a building and an air filter which purifies the air inside the cage. The air filter includes an ion generator which generates ions by a plasma discharge to discharge the ions into the cage, a dust sensor which detects a dust contamination level in the cage, and a controller which compares the dust contamination level detected by the dust sensor with a predetermined standard contamination level and operates the ion generator If the dust contamination level is equal to or greater than the predetermined standard contamination level.

11 Claims, 8 Drawing Sheets

AIR FILTER, ELEVATOR HAVING THE SAME AND AIR CONDITIONING CONTROL METHOD THEREOF

CROSS-REFERENCE TO RELATED APPLICATIONS

This application claims the benefit of Korean Patent Application No. 2007-0078662, filed on Aug. 6, 2007 in the Korean Intellectual Property Office, the disclosure of which is incorporated herein by reference.

BACKGROUND

1. Field

The present invention relates to an air filter, an elevator having the same and an air conditioning control method thereof, and, more particularly, to an air filter capable of purifying the air inside the elevator to be safe and pleasant using a micro plasma ion generator (MPI), an elevator having the same and an air conditioning control method thereof.

2. Description of the Related Art

Generally, an elevator which moves in a vertical direction of a building is installed in a multistory building in which it is difficult to go up and down the stairs or a building having a large floating population such as an apartment, a hospital and a department store to meet the convenience of passengers (users) of the building.

A door is installed in the elevator and the passengers get into the elevator through the door. Since the elevator moves up and down while the door is closed, an inner space of the elevator which is used by many passengers including a patient or bacteria carrier and transports a cargo is inevitably contaminated with various fine dust particles, smoke, noxious gas, mold, noxious bacteria and the like. From the characteristics of the elevator, since the circulation or discharge of the noxious gas is not efficiently performed due to a sealed space, the air inside the elevator is not pleasant. Accordingly, when the passengers get into the elevator having a contaminated inner space, the contaminated air in the elevator, the noxious bacteria and the like may enter into a body through respiratory organs or may be stuck to clothes or a body. Particularly, old people, weak people or children may be frequently exposed to various diseases (for example, a respiratory disease, a headache or the like).

To solve the above problems, Korean Patent Laid-open Publication No. 1996-0007420 discloses an air filter of an elevator capable of purifying the air inside the elevator into pleasant and fresh air by providing an air purifying function to the elevator.

In the air filter of the elevator disclosed in the Publication, an air discharge hole which communicates with the outside is formed at a specified position of an inner wall lower portion of a cage. A duct is connected to the outside of the air discharge hole to be formed toward an upper portion of the cage along an outer wall of the cage. A plurality of filters and a fan motor are installed at the upper end of the cage connected to the duct. When the fan motor is operated, the air inside the cage is sucked to pass through the air discharge hole, the duct and the filters. The air circulates through an air blowing hole communicating with the inside of the cage. In this circulation process, contaminants contained in the air are filtered in the filters. Thus, the air inside the elevator is forced to pass through the filters to be purified into pleasant and fresh air.

However, in the conventional air filter of the elevator, when a passenger determines that the air inside the cage is contaminated due to an unpleasant smell or the like, the passenger presses an operation switch installed on a control panel in the cage to operate the fan motor. Accordingly, there is a problem such that the air inside the elevator cannot be always maintained at a pleasant state. That is, since the passenger should determine a contamination level of the air inside the elevator after the passenger gets into the elevator, air purification is performed after the passenger has felt an unpleasant feeling. Further, when the air inside the elevator is severely contaminated (for example, when someone had a smoke or when a contaminant with a serious bad smell has been left), the time that it takes to purify the air in the elevator cage is lengthened. Thus, the passengers may suffer a considerable unpleasant feeling or discomfort.

Further, in the conventional air filter of the elevator, the contaminants contained in the air are filtered in the filters. However, since the fine dust particles which have not been filtered in the filters are directly transmitted to the passengers, there still exists a danger of a respiratory disease due to the fine dust particles.

SUMMARY

The present invention has been made to solve the above problems. It is an aspect of the invention to provide an air filter to efficiently remove various noxious materials and fine dust particles or the like inside an elevator using a micro plasma ion generator (MPI), an elevator having the same and an air conditioning control method thereof.

It is another aspect of the invention to provide an air filter to purify the air inside an elevator to make the air safe and pleasant by controlling the operation of an ion generator according to an amount of dust and a temperature in the elevator and operating a fan for air purification with the operation of the ion generator, an elevator having the same and an air conditioning control method thereof.

In accordance with an aspect of the invention, an air filter comprises: a filter which removes dust in the air; an ion generator which generates ions by a plasma discharge to remove fine dust particles that have passed through the filter; a dust sensor which detects a dust contamination level of the air; a controller which compares the dust contamination level detected by the dust sensor with a predetermined standard contamination level and operates the ion generator if the dust contamination level is equal to or greater than a standard contamination level.

Generally, the air filter further includes a temperature sensor which detects a temperature of the air, wherein the controller compares the temperature of the air detected by the temperature sensor with a predetermined standard temperature and operates the ion generator if the temperature of the air is equal to or greater than the predetermined standard temperature.

Typically, the air filter further includes a fan which is operated such that the air passes through the filter, wherein the controller operates the fan with an operation of the ion generator.

In accordance with another aspect of the invention, an air filter comprises: an ion generator which generates ions by a plasma discharge; a fan which is operated to discharge the ions generated in the ion generator; a dust sensor which detects a dust contamination level of the air flowing according to an operation of the fan; a controller which compares the dust contamination level detected by the dust sensor with a predetermined standard contamination level and operates the ion generator if the dust contamination level is equal to or greater than the predetermined standard contamination level.

Generally, the air filter further includes a temperature sensor which detects a temperature of the air, wherein the controller compares the temperature of the air detected by the temperature sensor with a predetermined standard temperature and operates the ion generator if the temperature of the air is equal to or greater than the predetermined standard temperature.

Typically, the air filter further includes a filter which removes dust in the air flowing according to the operation of the fan, wherein the ion generator is operated such that fine dust particles that have passed through the filter are ionized by the generated ions and removed.

In accordance with yet another aspect of the invention, an elevator comprises: a cage which moves up and down in a vertical direction of a building; and an air filter which purifies the air inside the cage, wherein the air filter includes: an ion generator which generates ions by a plasma discharge to discharge the ions into the cage; a dust sensor which detects a dust contamination level in the cage; and a controller which compares the dust contamination level detected by the dust sensor with a predetermined standard contamination level and operates the ion generator if the dust contamination level is equal to or greater than a predetermined standard contamination level.

Generally, the elevator further includes a temperature sensor which detects an inner temperature of the cage, wherein the controller compares the inner temperature detected by the temperature sensor with a predetermined standard temperature and operates the ion generator if the inner temperature is equal to or greater than the predetermined standard temperature.

Typically, the elevator further includes a fan which is operated to discharge the ions generated in the ion generator into the cage, wherein the controller operates the fan with an operation of the ion generator.

Generally, the air filter is installed to communicate with an outlet formed at an upper portion of the cage.

In accordance with yet another aspect of the invention, an elevator comprises: a cage which moves up and down in a vertical direction of a building; an ion generator which generates ions by a plasma discharge to discharge the ions into the cage; a dust sensor which detects a dust contamination level in the cage; and a controller which controls an operation of the ion generator according to the dust contamination level defected by the dust sensor, wherein the controller operates the ion generator if the dust contamination level is equal to or greater than a predetermined standard contamination level.

Typically, the elevator further includes a temperature sensor which detects an inner temperature of the cage, wherein the controller operates the ion generator If the inner temperature detected by the temperature sensor is equal to or greater than a predetermined standard temperature.

Generally, the elevator further includes a fan which is operated to discharge the ions generated in the ion generator into the cage, wherein the controller operates the fan with the operation of the ion generator.

In accordance with yet another aspect of the invention, a method controls an air filter which includes a filter, an ion generator and a dust sensor, wherein the method comprises: detecting a dust contamination level of fine dust particles which have passed the filter by a dust sensor; and comparing the detected dust contamination level with a predetermined standard contamination level and operating the ion generator to remove the fine dust particles which have passed through the filter if the dust contamination level is equal to or greater than the predetermined standard contamination level.

In accordance with yet another aspect of the invention, a method controls an air filter that includes a filter, an ion generator and a temperature sensor, wherein the method comprises: detecting a temperature of the air which has passed through the filter proximate to the temperature sensor; comparing the detected temperature of the air with a predetermined standard temperature and operating the ion generator to remove noxious materials contained in the air if the temperature of the air is equal to or greater than the predetermined standard temperature.

In accordance with yet another aspect of the invention, an air conditioning control method of an elevator includes a cage, an ion generator, a dust sensor and a temperature sensor, wherein the method comprises: detecting a dust contamination level in the cage by a dust sensor; and comparing the detected dust contamination level with a predetermined standard contamination level and operating the ion generator to remove fine dust particles in the cage if the dust contamination level is equal to or greater than the predetermined standard contamination level.

Generally, the air conditioning control method further includes detecting an inner temperature of the cage by the temperature sensor; and comparing the detected inner temperature with a predetermined standard temperature and operating the ion generator to remove noxious materials in the cage if the inner temperature is equal to or greater than the predetermined standard temperature.

In the air filter, the elevator having the same and the air conditioning control method thereof according to the present invention, the air inside the elevator is purified to be safe and pleasant by efficiently removing various noxious materials such as a virus or allergen floating in the air and active oxygen (OH-radical) contained in the air.

Further, according to the present invention, the operation of the ion generator is controlled according to the amount of dust and the temperature in the elevator. The fan for air purification is operated with the operation of the ion generator. The fine dust particles which have not been filtered in the filter or are introduced into the elevator when the door is opened and closed are conglomerated and removed. Thus, a respiratory disease caused by the fine dust particles is prevented.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE EMBODIMENTS

Figure 1:
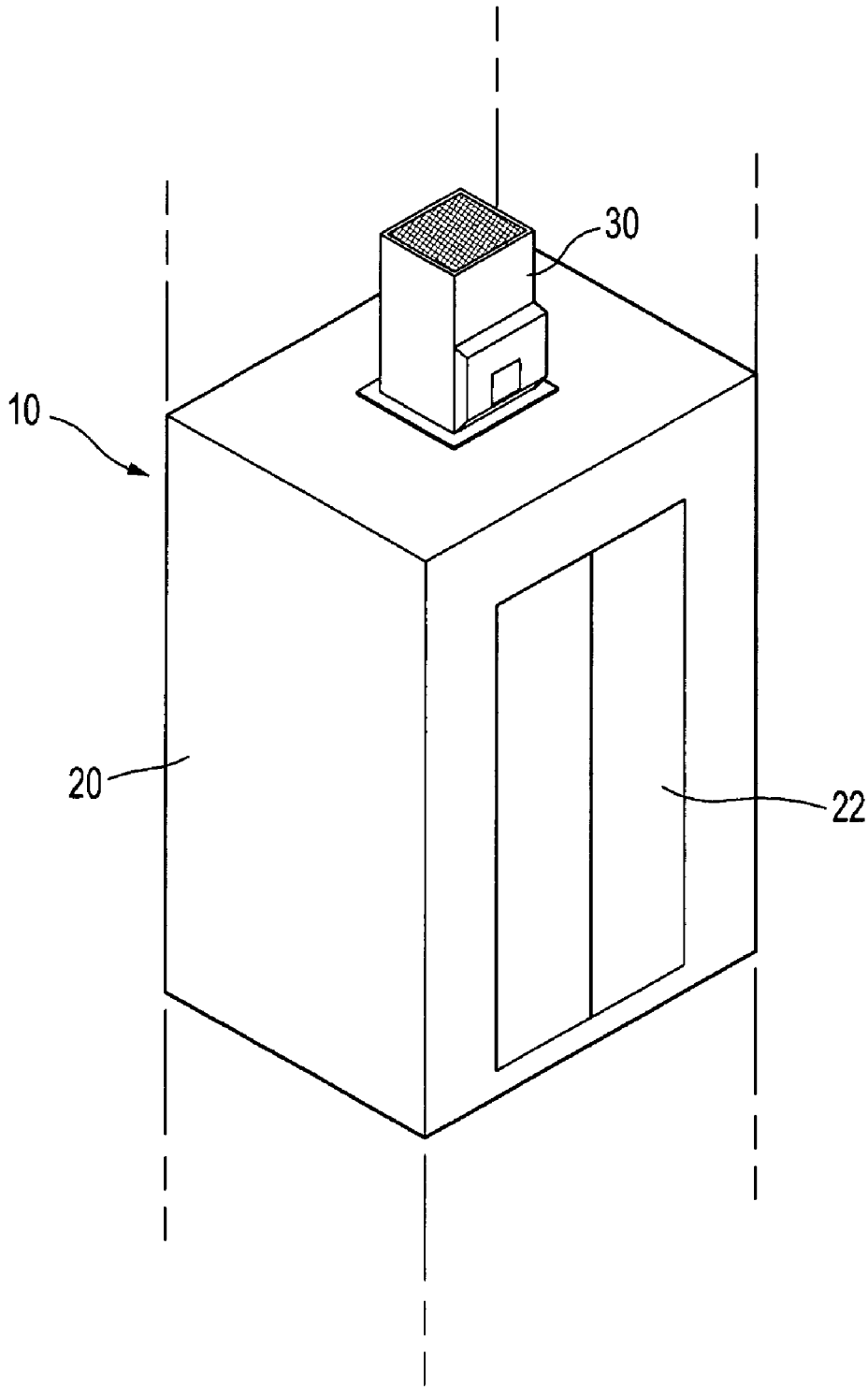
FIG. 1 illustrates a perspective view showing an external appearance of an elevator having an air filter according to an embodiment of the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

Hereinafter, an embodiment according to the present invention will be described in detail with reference to the accompanying drawings.

Figure 2:
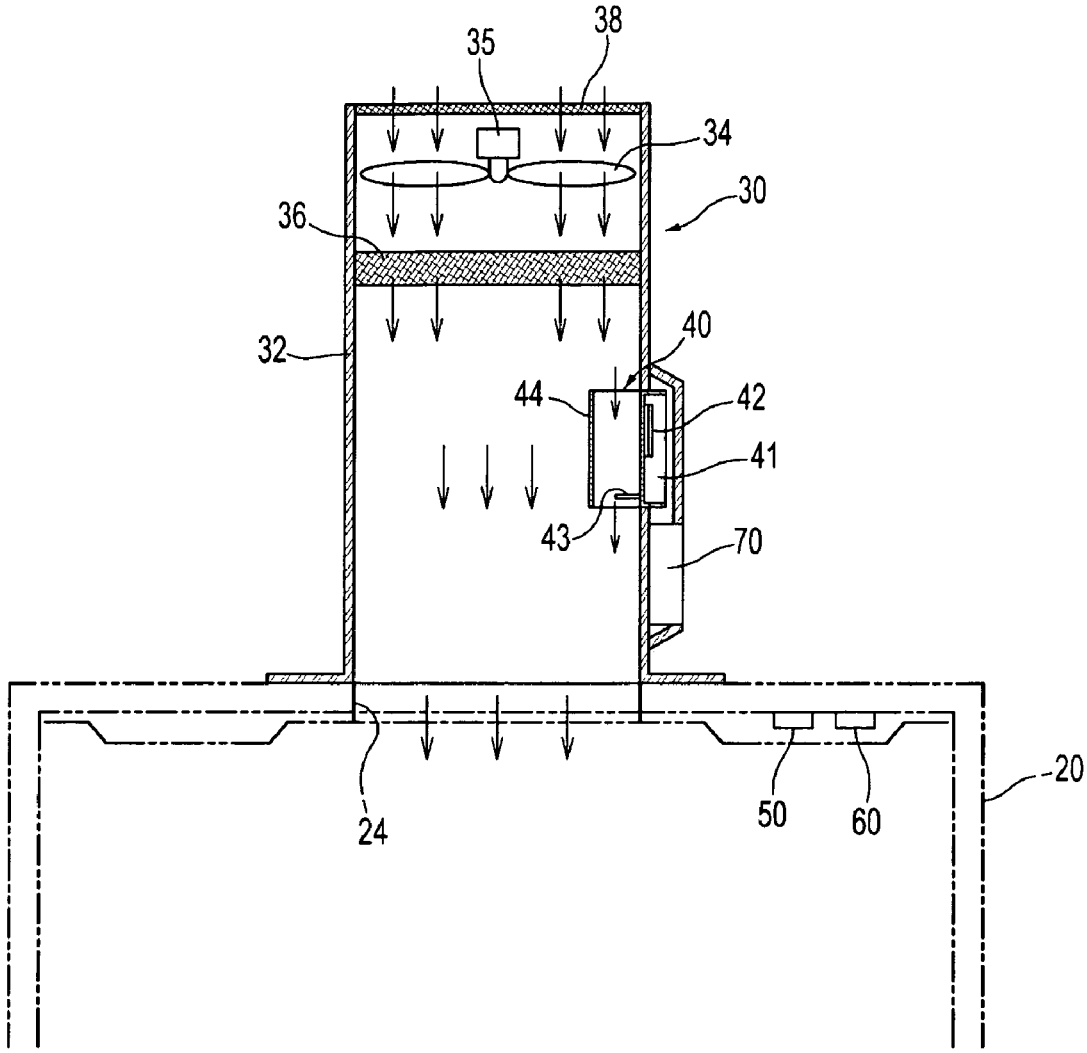
FIG. 2 illustrates a cross-sectional view schematically showing the air filter according to the embodiment of FIG. 1 of the present invention.

FIG. 1 illustrates a perspective view showing an external appearance of an elevator having an air filter according to an embodiment of the present invention. FIG. 2 illustrates a cross-sectional view schematically showing the air filter according to an embodiment of the present invention.

As shown in FIGS. 1 and 2, an elevator 10 having an air filter 30 according to the present invention includes a cage 20 which passengers get into and the air filter 30 formed at an upper portion of the cage 20 to communicate with a ventilation duct for ventilation of the elevator 10.

A door 22 is installed on one side (a front surface) of the cage 20 to open and close the cage 20 for entrance and exit of the passengers or a cargo. An outlet 24 is formed at a specified position of an inner wall upper portion of the cage 20 to communicate with the air filter 30. Various noxious materials, fine dust particles and the like inside the cage 20 are removed by ions discharged through the outlet 24 in an operation of the air filter 30, thereby purifying the air inside the cage 20 to make the air safe and pleasant.

The air filter 30 includes an air purifying duct 32 installed to communicate with the ventilation duct (not shown) for ventilation of the elevator 10, a fan 34 installed at one side of the air purifying duct 32 to blow air by the rotation of a fan motor 35, a filter 36 which removes various contaminants and large dust particles contained in the air introduced into the cage 20 through a suction inlet 38 by the operation of the fan 34, and an ion generator 40 which generates ions to remove various noxious materials and fine dust particles which have not been removed through the filter 36.

Further, the air filter 30 further includes a dust sensor 50 which detects a dust contamination level and a temperature of a space equipped with the air filter 30 (for example, an inner space of the elevator) and a temperature sensor 60. The air filter 30 further includes a controller 70 which controls the operation of the ion generator 40 according to values detected by the dust sensor 50 and the temperature sensor 60.

Figure 3:
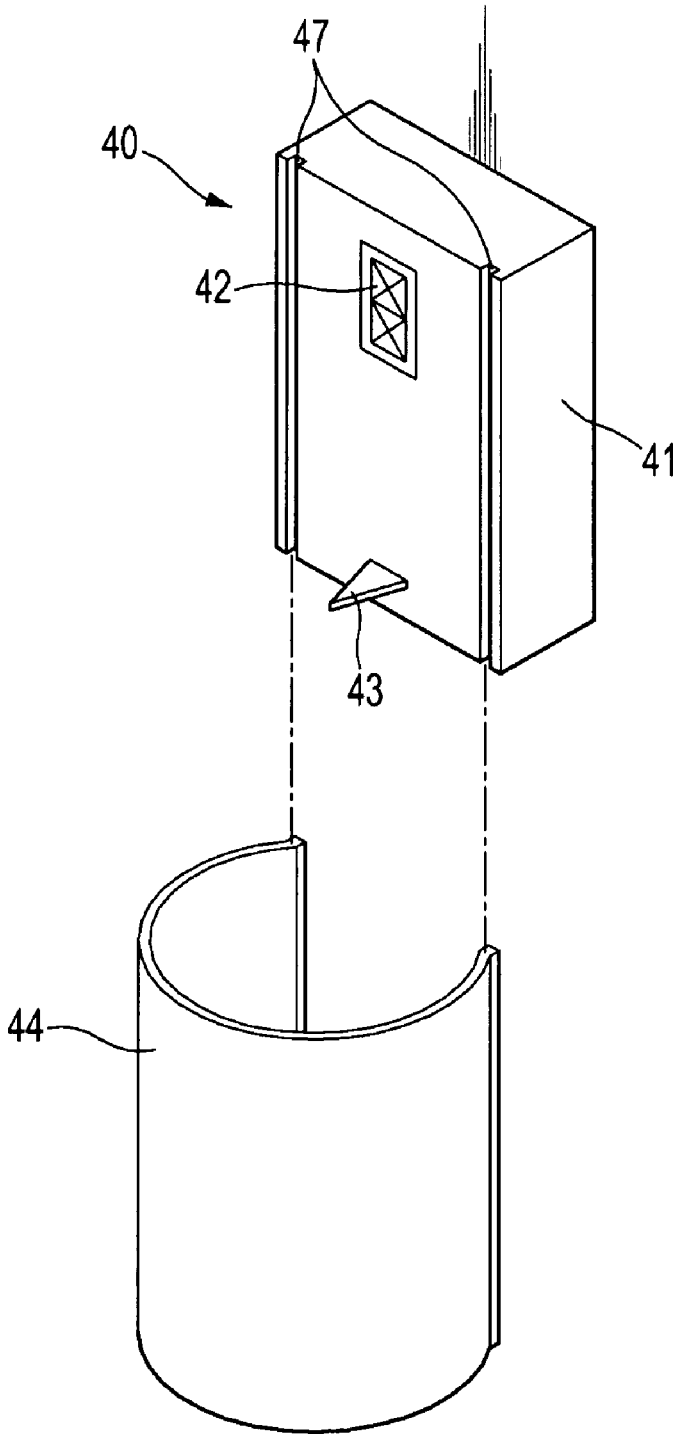
FIG. 3 illustrates a perspective view showing an ion generator according to the embodiment of FIG. 1 of the present invention.
Figure 4:
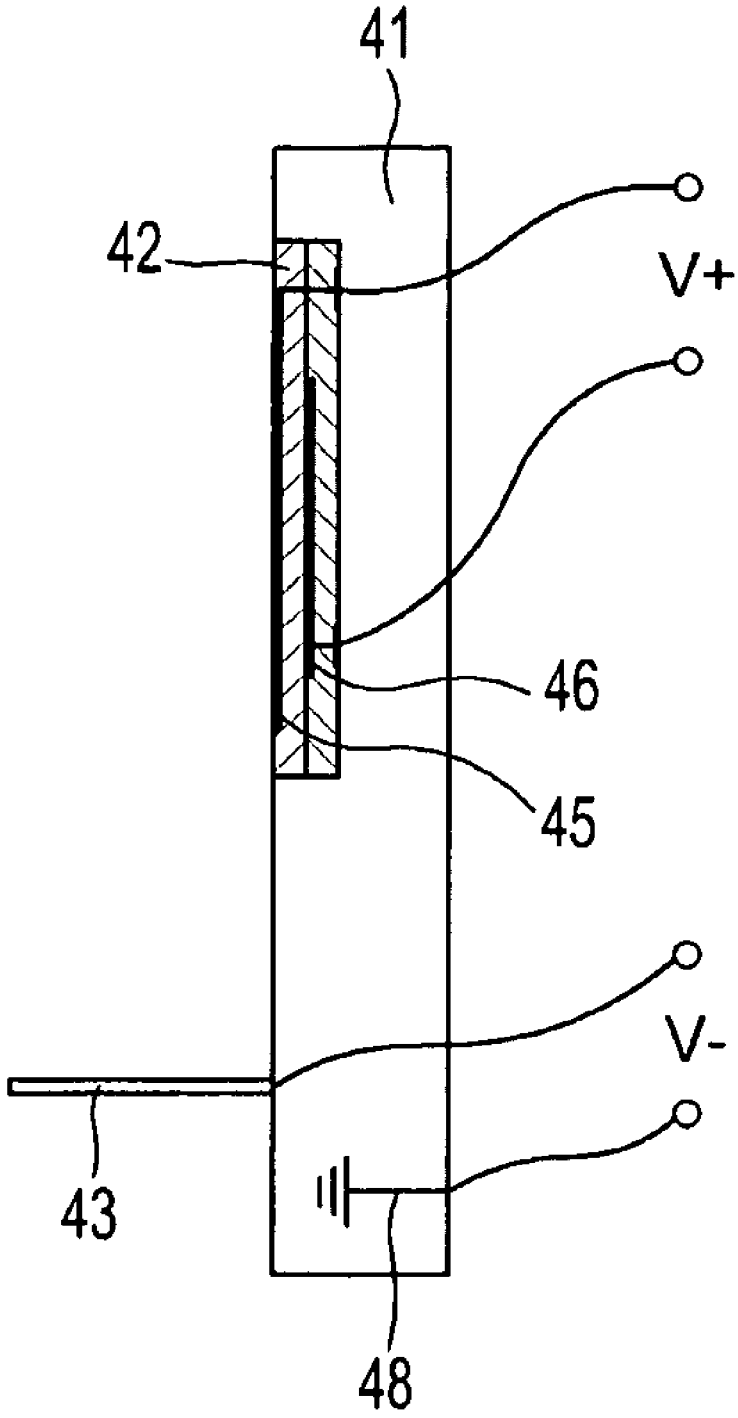
FIG. 4 illustrates a cross-sectional view schematically showing the ion generator shown in FIG. 3.
Figure 5:
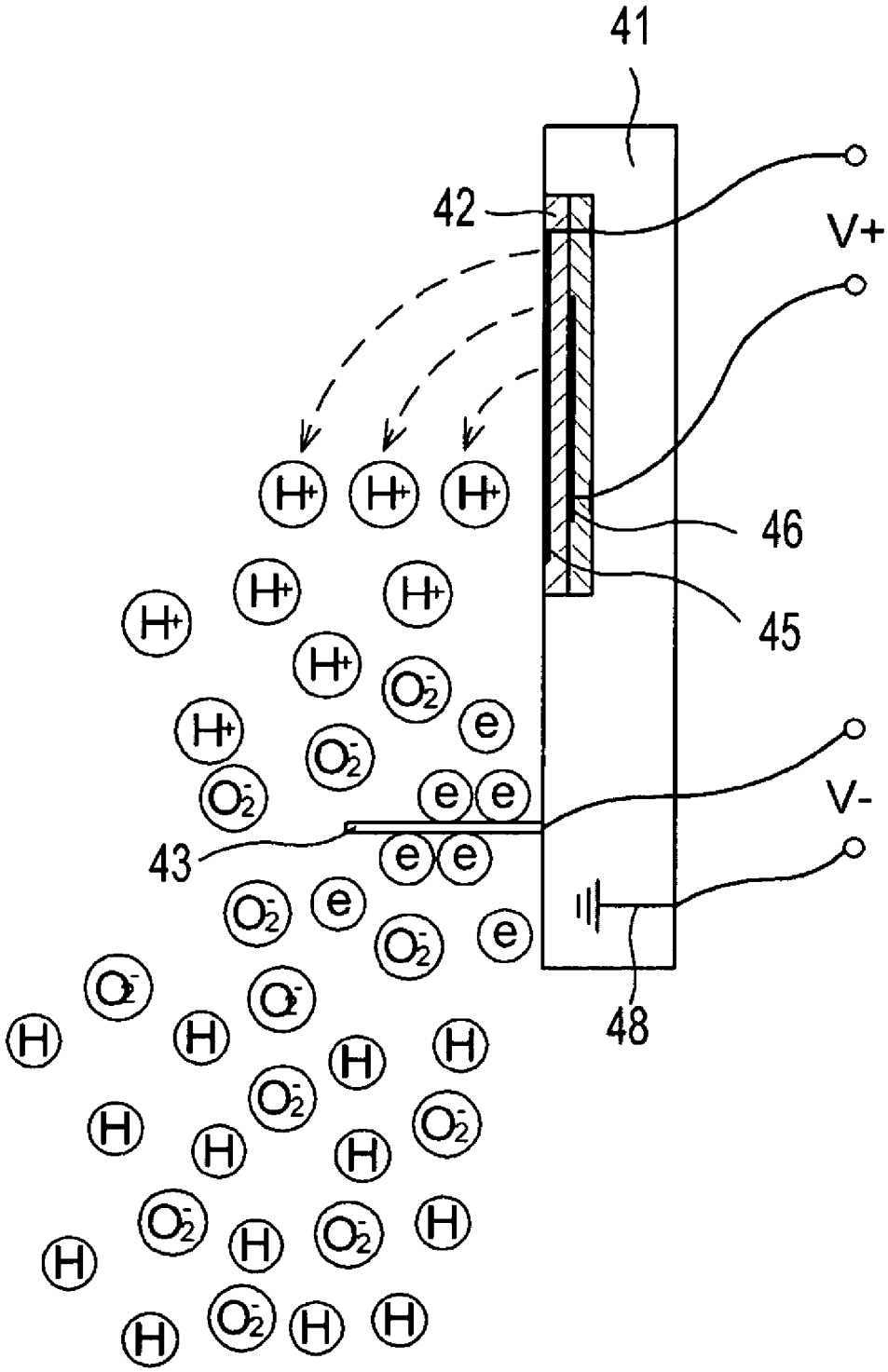
FIG. 5 illustrates ions generated from the ion generator of FIG. 4.

FIG. 3 illustrates a perspective view showing an ion generator according to an embodiment of the present invention. FIG. 4 illustrates a cross-sectional view schematically showing the ion generator shown in FIG. 3. FIG. 5 illustrates ions generated from the ion generator of FIG. 4.

In FIGS. 3 and 4, the ion generator 40 is a micro plasma ion generator (MPI) which is operated with the fan 34. The ion generator 40 includes a ceramic plate 42 installed on an upper surface of a bedplate 41 to generate positive ions and a needle-like electrode 43 installed to be spaced at a specified distance from the ceramic plate 42 to generate negative ions. A cover 44 is slidingly-coupled to a guide groove 47 formed at an upper end of the bedplate 41 in a longitudinal direction to restrict a diffusion range of the generated ions within a specified space.

A recessed space is provided on an upper surface of the bedplate 41 to install the ceramic plate 42. The ceramic plate 42 is inserted and installed in the recessed space. The ceramic plate 42 is provided to generate positive ions. A discharge electrode 45 is disposed at an inner upper portion of the ceramic plate 42. An induction electrode 46 is disposed at an inner central portion of the ceramic plate 42. Further, a protection layer is formed of ceramic on a portion excluding the discharge electrode 45 and the induction electrode 46.

When a high voltage (about 3.9~4.3 kV) of a plus component is applied between the discharge electrode 45 and the induction electrode 46, as shown in FIG. 5, moisture ($H_20$) in the air is ionized by a plasma discharge to generate positive ions of hydrogen ($H^+$) around the ceramic plate 42.

Meanwhile, the needle-like electrode 43 is installed on the upper surface of a bedplate 41 to protrude at a position spaced by a specified distance from the ceramic plate 42. Among the hydrogen ions generated in the ceramic plate 42, the number of the hydrogen ions converted into hydrogen atoms varies according to a spacing distance between the needle-like electrode 43 and the ceramic plate 42. Accordingly, generally the spacing distance is controlled according to the size of the ceramic plate 42, the height of the needle-like electrode 43 and the like.

A reference numeral 48 is a ground electrode.

When a high voltage (about 3.2~3.6 kV) of a minus component is applied between the needle-like electrode 43 and the ground electrode 48, as shown in FIG. 5, positive ions are accumulated around the needle-like electrode 43 by a plasma discharge, and a large amount of electrons in the needle-like electrode 43 are discharged into the air. Since the large amount of electrons discharged into the air are very unstable, the electrons are combined with oxygen molecules ($O_2$) to generate electrons and negative ions of super oxide anions ($O_2^-$) as shown in FIG. 5.

When electrons are discharged from the needle-like electrode 43, the electrons are generated from the ceramic plate 42 and are combined with hydrogen ions ($H^+$) passing around the needle-like electrode 43 to produce hydrogen atoms (or active hydrogen H). The hydrogen ions ($H^+$) generated from the ceramic plate 42 are combined with electrons discharged from the needle-like electrode 43 to form hydrogen atoms (H). Thus, materials finally discharged from the ion generator 40 are the hydrogen atoms (H) and the super oxide anions ($O_2^-$).

As described above, when the hydrogen atoms (H) and the super oxide anions ($O_2^-$) are produced, the super oxide anions ($O_2^-$) having polarity opposite to static electricity (+) of bacteria are adsorbed on the surface of the bacteria by static electricity of bacteria floating in the air. When the super oxide anions ($O_2^-$) are adsorbed on the bacteria, the hydrogen atoms (H) are adsorbed on the super oxide anions ($O_2^-$) by the super oxide anions ($O_2^-$). When the hydrogen atoms (H) are adsorbed on the super oxide anions ($O_2^-$), sterilization is performed.

The flow of the air moving according to the operation of the air filter 30 having the ion generator 40 of the above configuration is shown in FIG. 2.

As shown in FIG. 2, when the fan 34 is operated, the air is sucked through the suction inlet 38 formed at one side of the air purifying duct 32 communicating with the ventilation duct (not shown). While the sucked air passes through the filter 36, the various contaminants and large dust particles contained in the air are removed from the air. Then, fine dust particles which have passed through the filter 36 and fine dust particles inside the cage 20 are ionized by ions from the ion generator 40 and are conglomerated to form large dust particles which sink to the bottom of the cage 20, thereby gradually reducing an amount of fine dust particles in the air. The fine dust particles which are not caught in the filter 36 or are introduced into the cage 20 when the door 22 is opened and closed are efficiently removed according to the above operation.

Figure 6:
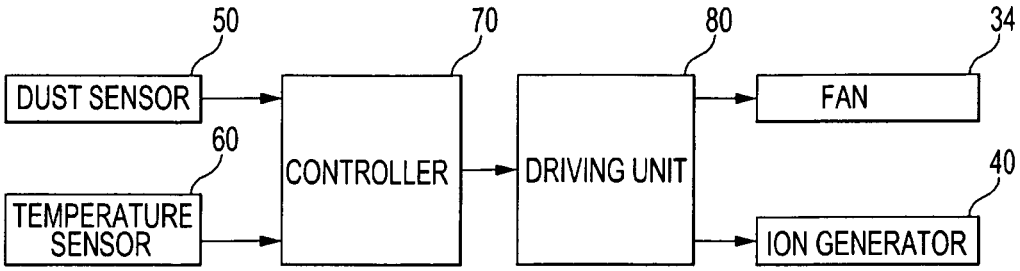
FIG. 6 illustrates a control block diagram of an elevator having an air filter according to an embodiment of the present invention.

FIG. 6 illustrates a control block diagram of the elevator having the air filter according to an embodiment of the present invention, which includes the dust sensor 50, the temperature sensor 60, the controller 70 and a driving unit 80.

The dust sensor 50 detects a dust contamination level of the inside of a space (for example, a cage) equipped with the air filter 30, and transmits the detected dust contamination level to the controller 70. The temperature sensor 60 detects an inner temperature of the space (for example, a cage) equipped with the air filter 30 and transmits the detected inner temperature to the controller 70.

Accordingly, when the dust contamination level detected by the dust sensor 50 is equal to or greater than a predetermined standard contamination level, the controller 70 determines that the air inside the space (for example, a cage) equipped with the air filter 30 is contaminated and the amount of dust floating in the air is greater than an acceptable level. Then, the controller 70 operates the ion generator 40 and the fan 34.

Further, when the inner temperature detected by the temperature sensor 60 is equal to or greater than a predetermined standard temperature, the controller 70 determines that the inner temperature of the space (for example, a cage) equipped with the air filter 30 is in a temperature range capable of propagating various noxious materials. Then, the controller 70 operates the ion generator 40 and the fan 34.

The driving unit 80 drives the fan 34 and the ion generator 40 according to driving control signals of the controller 70.

Hereinafter, an operation process and an effect of the air filter having the above configuration, an elevator having the air filter and an air conditioning control method thereof will be described.

Figure 7:
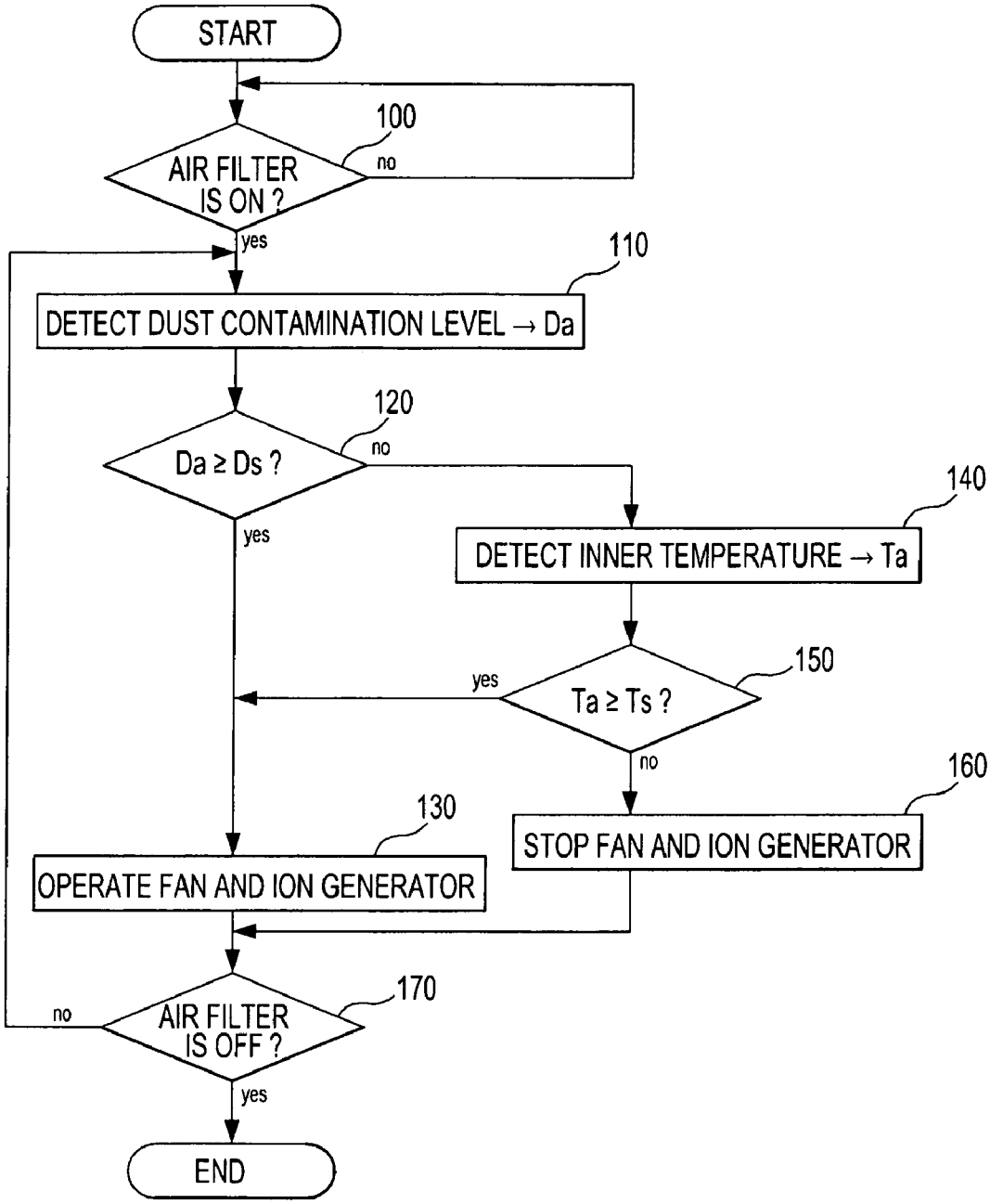
FIG. 7 illustrates a flowchart showing an air conditioning control operation process in the elevator having an air filter according to an embodiment of the present invention.

FIG. 7 illustrates a flowchart showing an air conditioning control operation process in the elevator having the air filter according to the embodiment of the present invention.

First, when the elevator 10 having the air filter 30 moves up and down, it is determined whether an ON operation is applied to the air filter 30 (operation 100). If the air filter 30 is in an ON operation, the dust sensor 50 installed in the space (for example, a cage) equipped with the air filter 30 detects the dust contamination level Da in the cage 20 (operation 110).

The dust contamination level Da detected in the dust sensor 50 is transmitted to the controller 70. The controller 70 compares the detected dust contamination level Da with a predetermined standard contamination level Ds (operation 120). If the detected dust contamination level Da is equal to or greater than the standard contamination level Ds, the controller 70 determines that the air inside the cage 20 is contaminated and the amount of dust floating in the air is larger than an acceptable level. Then, the controller 70 operates the fan 34 and the ion generator 40 (operation 130).

Accordingly, the ions generated in the ion generator 40 are discharged into the cage 20 through the outlet 24 according to the operation of the fan 34. Then, fine dust particles inside the cage 20 are ionized and conglomerated to form large dust particles which sink to the bottom of the cage 20, thereby gradually reducing an amount of the fine dust particles. Thus, respiratory disease caused by the fine dust particles is prevented.

Figure 8:
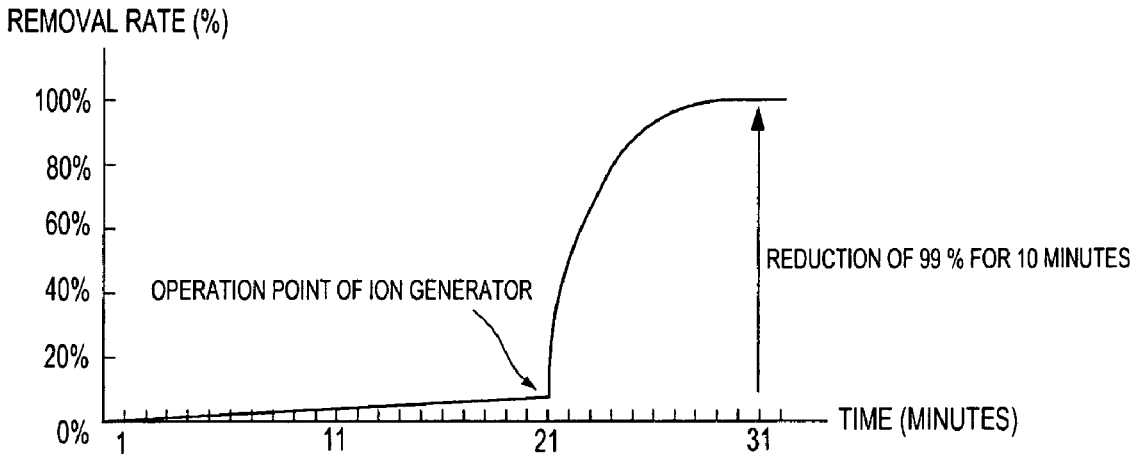
FIG. 8 is a graph showing a removal rate of the fine dust particles according to the operation of the ion generator according to an embodiment of the present invention.

FIG. 8 is a graph showing a removal rate of the fine dust particles according to the operation of the ion generator according to an embodiment of the present invention.

As shown in FIG. 8, from the result of testing a removal rate of the fine dust particles of 0.1~2 μm, it is known that the fine dust particles are reduced by about 99% when the ion generator 40 is operated for 10 minutes or more.

Meanwhile, as the determination result of the operation 120, if the detected dust contamination level Da is smaller than the standard contamination level Ds, the controller 70 determines that the amount of dust floating in the air inside the cage 20 is lower than an acceptable amount. Then, the inner temperature Ta of the cage 20 is detected by the temperature sensor 60 installed in the cage 20 (operation 140).

The inner temperature Ta detected by the temperature sensor 60 is transmitted to the controller 70. The controller 70 compares the detected inner temperature Ta with a predetermined standard temperature Ts (operation 150). If the detected inner temperature Ta is equal to or greater than the standard temperature Ts, the controller 70 determines that the inner temperature of the cage 20 is in a temperature range capable of propagating various noxious materials. Then, the process returns to the operation 130 wherein the controller 70 operates the fan 34 and the ion generator 40.

Accordingly, the ions generated in the ion generator 40 are discharged into the cage 20 through the outlet 24 according to the operation of the fan 34. Then, various noxious materials such as viruses or allergy causing materials that are floating in the cage 20 can be removed, and active oxygen ($OH^-$radical) in the air can be efficiently removed. The detailed description thereof is disclosed in Korean Patent Laid-open Publication No. 2006-0010234, which is filed by an applicant of the present invention.

Meanwhile, as the determination result of the operation 150, if the detected inner temperature Ta is smaller than the standard temperature Ts, the controller 70 determines that the amount of dust floating in the air inside the cage 20 is lower than an acceptable amount, and the inner temperature of the cage 20 is not in a temperature range capable of propagating various noxious materials. Then, the controller 70 stops the fan 34 and the ion generator 40 (operation 160).

Thereafter, it is determined whether the air filter 30 is in an OFF operation (operation 170). If the air filter 30 is in an OFF operation, all load operations of the air filter 30 are completed. If the air filter 30 is not in an OFF operation, the process returns to the operation 110, and the next operations are performed.

Meanwhile, although the air filter 30 is installed to communicate with the ventilation duct (not shown) for ventilation of the elevator 10 in this embodiment, the present invention is not limited thereto. The air filter 30 may be installed separately from the ventilation duct. The same aspects and effects as those of the present invention can be achieved in this structure.

Although embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An elevator comprising:

a cage which moves up and down in a vertical direction of a building; and an air filter which purifies air inside the cage, wherein the air filter includes:

an ion generator which generates ions by a plasma discharge to discharge the ions into the cage;

a dust sensor which detects a dust contamination level in the cage;

a controller which compares the dust contamination level detected by the dust sensor with a predetermined standard contamination level and operates the ion generator if the dust contamination level is equal to or greater than the predetermined standard contamination level; and a temperature sensor which detects an inner temperature of the cage, wherein the controller compares the inner temperature detected by the temperature sensor with a predetermined standard temperature and operates the ion generator if the inner temperature is equal to or greater than the predetermined standard temperature.

2. The elevator according to claim 1, further comprising a fan which is operated to discharge the ions generated in the ion generator into the cage, wherein the controller operates the fan with an operation of the ion generator.

3. The elevator according to claim 1, wherein the air filter is installed to communicate with an outlet formed at an upper portion of the cage.

4. An elevator comprising:

a cage which moves up and down in a vertical direction of a building;

an ion generator which generates ions by a plasma discharge to discharge the ions into the cage;

a dust sensor which detects a dust contamination level in the cage; and a controller which controls an operation of the ion generator according to the dust contamination level detected by the dust sensor, wherein the controller operates the ion generator if the dust contamination level is equal to or greater than a predetermined standard contamination level, and the ion generator includes a ceramic plate installed on an upper surface of a bedplate to generate positive ions and a needle-shaped electrode spaced at a specified distance from the ceramic plate to generate negative ions.

5. The elevator according to claim 4, further comprising a temperature sensor which detects an inner temperature of the cage, wherein the controller operates the ion generator if the inner temperature detected by the temperature sensor is equal to or greater than a predetermined standard temperature.

6. The elevator according to claim 4, further comprising a fan which is operated to discharge the ions generated in the ion generator into the cage, wherein the controller operates the fan with the operation of the ion generator.

7. The air filter according to claim 4, further including a discharge electrode disposed at an inner upper portion of the ceramic plate.

8. The air filter according to claim 4, further including an induction electrode disposed at an inner central portion of the ceramic plate.

9. The air filter according to claim 4, further including a discharge electrode and an induction electrode at an inner upper portion of the ceramic plate, and a protection layer formed of ceramic on a portion of the ceramic plate excluding the discharge electrode and the induction electrode.

10. An air conditioning control method of an elevator including a cage, an ion generator, a dust sensor and a temperature sensor, the method comprising:

detecting a dust contamination level in the cage by a dust sensor;

comparing the detected dust contamination level with a predetermined standard contamination level and operating the ion generator to remove fine dust particles in the cage if the dust contamination level is equal to or greater than the predetermined standard contamination level;

detecting an inner temperature of the cage by the temperature sensor; and comparing the detected inner temperature with a predetermined standard temperature and operating the ion generator to remove noxious materials in the cage if the inner temperature is equal to or greater than the predetermined standard temperature.

11. An elevator comprising:

a cage which moves up and down in a vertical direction of a building;

an ion generator which generates ions by a plasma discharge to discharge the ions into the cage;

a dust sensor which detects a dust contamination level in the cage; and a controller which controls an operation of the ion generator according to the dust contamination level detected by the dust sensor, wherein the controller operates the ion generator if the dust contamination level is equal to or greater than a predetermined standard contamination level, and the ion generator includes a ceramic plate installed on an upper surface of a bedplate to generate positive ions and a cover slidingly coupled to a guide groove formed at an upper end of the bedplate in a longitudinal direction to restrict a diffusion range of generated ions within a predetermined space.

* * * * *